US005671866A

United States Patent [19]

Bodziak

[11] Patent Number: 5,671,866

[45] Date of Patent: Sep. 30, 1997

[54] REFILLABLE SHEET DISPENSER WITH STORAGE

[75] Inventor: Douglas P. Bodziak, Lake Elmo, Minn.

[73] Assignee: Minnesota Mining and Manufacturing Company, St. Paul, Minn.

[21] Appl. No.: 578,072

[22] Filed: Dec. 27, 1995

[51] Int. Cl.[6] ..... A47K 10/24

[52] U.S. Cl. ..... 221/45; 221/59

[58] Field of Search ..... 221/33, 45, 49, 221/48, 59, 56, 58; 206/449, 555, 556

[56] References Cited

U.S. PATENT DOCUMENTS

| | | | |
|---|---|---|---|
| 4,416,392 | 11/1983 | Smith | 221/45 |
| 4,653,666 | 3/1987 | Mertens | 221/45 |
| 4,781,306 | 11/1988 | Smith | 221/33 |
| 4,907,825 | 3/1990 | Miles et al. | 281/51 |
| 5,086,946 | 2/1992 | Blackwell et al. | 221/45 |
| 5,143,250 | 9/1992 | Freitag | 221/59 |
| 5,299,712 | 4/1994 | Carlson et al. | 221/45 |

FOREIGN PATENT DOCUMENTS

| | | | |
|---|---|---|---|
| WO92/13785 | 8/1992 | WIPO | B65H 1/00 |

*Primary Examiner*—Kenneth Noland
*Attorney, Agent, or Firm*—Gary L. Griswold; Walter N. Kirn; William L. Huebsch

[57] ABSTRACT

A refillable sheet dispenser of the type having walls defining a cavity adapted to receive a stack of sheets including first and second end walls at opposite ends of a side wall with the first end wall having an elongate outlet opening through which individual sheets from the stack in the cavity may be manually withdrawn, while the stack of sheets is biased toward the first end wall. The biasing is provided by a strip of non metallic material bent to provide the biasing force and to provide space within it in which refill stacks of sheets or other items may be stored.

5 Claims, 1 Drawing Sheet

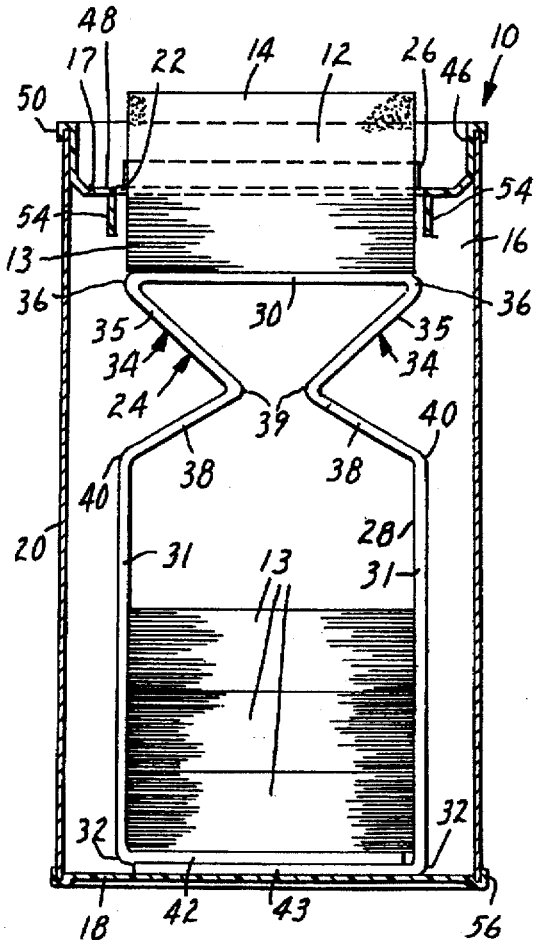

US005671866A

United States Patent [19]

Bodziak

[11] Patent Number: 5,671,866

[45] Date of Patent: Sep. 30, 1997

[54] REFILLABLE SHEET DISPENSER WITH STORAGE

[75] Inventor: Douglas P. Bodziak, Lake Elmo, Minn.

[73] Assignee: Minnesota Mining and Manufacturing Company, St. Paul, Minn.

[21] Appl. No.: 578,072

[22] Filed: Dec. 27, 1995

[51] Int. Cl.[6] ..... A47K 10/24

[52] U.S. Cl. ..... 221/45; 221/59

[58] Field of Search ..... 221/33, 45, 49, 221/48, 59, 56, 58; 206/449, 555, 556

[56] References Cited

U.S. PATENT DOCUMENTS

| | | | |
|---|---|---|---|
| 4,416,392 | 11/1983 | Smith | 221/45 |
| 4,653,666 | 3/1987 | Mertens | 221/45 |
| 4,781,306 | 11/1988 | Smith | 221/33 |
| 4,907,825 | 3/1990 | Miles et al. | 281/51 |
| 5,086,946 | 2/1992 | Blackwell et al. | 221/45 |
| 5,143,250 | 9/1992 | Freitag | 221/59 |
| 5,299,712 | 4/1994 | Carlson et al. | 221/45 |

FOREIGN PATENT DOCUMENTS

| | | | |
|---|---|---|---|
| WO92/13785 | 8/1992 | WIPO | B65H 1/00 |

*Primary Examiner*—Kenneth Noland
*Attorney, Agent, or Firm*—Gary L. Griswold; Walter N. Kirn; William L. Huebsch

[57] ABSTRACT

A refillable sheet dispenser of the type having walls defining a cavity adapted to receive a stack of sheets including first and second end walls at opposite ends of a side wall with the first end wall having an elongate outlet opening through which individual sheets from the stack in the cavity may be manually withdrawn, while the stack of sheets is biased toward the first end wall. The biasing is provided by a strip of non metallic material bent to provide the biasing force and to provide space within it in which refill stacks of sheets or other items may be stored.

5 Claims, 1 Drawing Sheet

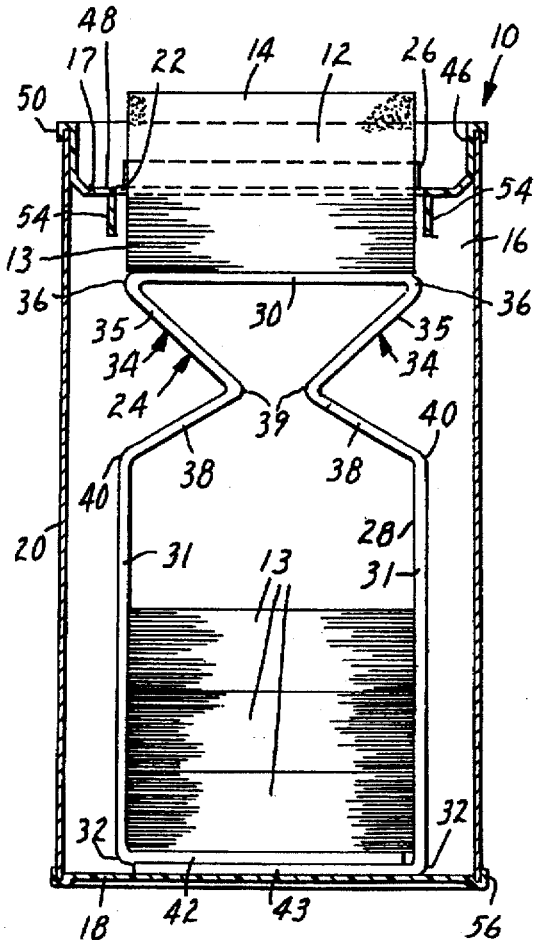

REFILLABLE SHEET DISPENSER WITH STORAGE

TECHNICAL FIELD

The present invention relates generally to dispensers for pressure sensitive adhesive coated sheets.

BACKGROUND ART

Refillable dispensers adapted to dispense pressure sensitive adhesive coated sheets are known. U.S. Pat. No. 5,086,946 (Blackwell et al) issued Feb. 11, 1992, (the content whereof is incorporated herein by reference) describes such a dispenser, and includes a discussion of the background art relating to such dispensers; whereas another such refillable dispenser is described in U.S. Pat. No. 5,299,712 (Carlson et al).

Also, sheet dispensers for flexible sheets from a stack of sheets disposed one on top of another are known in which the sheet dispenser comprises walls defining a cavity adapted to receive the stack including first and second end walls at opposite ends of a side wall with the first end wall having an elongate outlet opening through which individual sheets from the stack in the cavity may be manually withdrawn; and means in the cavity for biasing the stack of sheets toward the first end wall (see U.S. Pat. Nos. 4,416,392 and 4,653,666). Heretofore, the means for biasing the stack of sheets toward the first end wall has either been a coil spring, which could present a safety problem under some circumstances; or a piece of resiliently compressible material (e.g., polymeric foam such as closed cell Styrofoam). Both the coil spring and the piece of resiliently compressible material typically fill the space beneath the stack of sheets being dispensed.

DISCLOSURE OF THE INVENTION

The present invention provides an inexpensive refillable dispenser from which sheets in a stack of sheets of the type described in U.S. Pat. Nos. 4,781,306 (Smith) or 4,907,825 (Miles et al) can be dispensed, which dispenser includes biasing means facilitating dispensing of the sheets that is safe to handle an affords storage for a pad of sheets that can be used to refill the dispenser, or other items.

The sheet dispenser according to the present invention is for a stack of sheets disposed one on top of another, and comprises walls defining a cavity adapted to receive the stack including first and second end walls at opposite ends of a side wall with the first end wall having an elongate outlet opening through which individual sheets from the stack in the cavity may be manually withdrawn. Novel means are provided in the cavity for biasing the stack of sheets toward the first end wall. That means comprises an elongate strip of stiff resiliently flexible material (e.g., 30 point craft card stock). The strip has transverse bends at spaced locations which shape the strip and is resiliently flexible at those bends. The transverse bends in the strip define (1) a generally planar pad support portion having an upper surface positioned adjacent the first end wall of the housing adapted to engage the side of the pad opposite the end wall; (2) two locating portions of about equal length disposed generally at right angles to the pad support portion and disposed generally in alignment with the opposite ends of the pad support portion, which locating portions have supported ends opposite the pad support portion supported on the walls, and (3) two force directing portions between the pad support portion and the locating portions. The two force directing portions include first force directing parts of about equal length having first ends attached by bends at the opposite ends of the support portion, disposed at an acute angle with respect to the pad support portion and projecting generally toward each other along a surface of the pad support portion opposite its upper surface; and two second force directing parts of about equal length, having inner ends attached by bends at the ends of the first force directing parts opposite their first ends, which second force directing parts extend generally away from each other from their inner ends and have ends opposite their inner ends attached by bends to the ends of the locating portions opposite their supported ends.

The normal height of the shaped strip between its pad support portion and its supported ends is greater than space available in the chamber when the stack of sheets is in the chamber. The orientation of the force directing parts and the resilient flexibility of the bends at the ends of those parts, however, allows resiliently flexible movement of the pad support portion toward the locating portions in a direction normal to its upper surface when both the stack of sheets and the shaped strip are in the chamber. The resiliently flexible bends then apply a spring-like force against the stack of sheets to facilitate proper dispensing of the sheets through the outlet opening.

The space between and length of the locating portions can be adapted to afford storage of one or more (e.g., five) refill pads of notes in the space between the locating portions; and preferably the dispenser includes means for affording releasable engagement of at least one of the end walls with the side wall to afford removing the shaped strip from the chamber and moving a pad from between its base portions to a position adjacent said top wall from whence the sheets on the pad can be dispensed.

When the shaped strip is made of craft card stock (e.g., 30 point) it can provide sufficient force against the pad to facilitate proper dispensing (e.g., about 200 grams on a 50 sheet pad reducing to about 20 grams for the last sheets dispensed from that pad), which force, while decreasing somewhat even under appropriate storage conditions, can provide sufficient force so that the dispenser will work properly for a fairly long time. Such a shaped strip can be removed from the cavity without any concern that it could injure the person who removes it.

While the sheet dispenser could have a plurality of side walls disposed in rectangular, hexagonal or other patterns, the embodiment illustrated herein has a cylindrical side wall which can have the same inexpensive construction as a conventional mailing tube. The removable end wall illustrated has a structure very similar to a removable polymeric end cap used on such a mailing tube. Thus, the entire sheet dispensing structure illustrated herein, including its walls and its shaped strip spring means, are inexpensive to construct and thus suitable to be given away for advertising purposes with information about the item being advertised on a paper label pasted around (or printed around) the cylindrical outer surface of the side wall. In addition to stacks of sheets for refilling the dispenser, product samples and/or product literature can be provided in the space between the locating portions.

BRIEF DESCRIPTION OF THE DRAWING

The present invention will be further described with reference to the accompanying drawing wherein like reference numerals refer to like parts in the several views, and wherein:

FIG. 1 is a top view of a refillable dispenser according to the present invention;

FIG. 2 is a cross sectional view taken approximately along line 2—2 of FIG. 1 that illustrates stacks of sheets in the refillable dispenser of FIG. 1; and FIG. 3 is a cross sectional view taken approximately along line 3—3 of FIG. 1 that also illustrates stacks of sheets in the refillable dispenser of FIG. 1.

DETAILED DESCRIPTION

Referring now to the drawing, there is shown a refillable sheet dispenser according to the present invention generally designated by the reference numeral 10.

The dispenser 10 is used for dispensing adhesive-bearing flexible paper sheets 12 from a coherent stack 13 of those sheets 12 of the type sold by Minnesota Mining and Manufacturing Company, St. Paul, Minn., under the trade designation "Pop'n Jot" (™) "Post-it" (™) notes. Such a stack of sheets is generally of the type described in U.S. Pat. No. 4,416,392, the content whereof describing the sheets and the way they are disposed in a stack is incorporated herein by reference. Generally, on an underside or second surface of each of the adhesive-bearing paper sheets 12 is a layer or narrow band of pressure-sensitive adhesive adjacent a second end of the sheet, with the bands of adhesive on successive sheets 12 being at opposite sides of the stack 13. Both first and second surfaces of each of the adhesive-bearing paper sheets 12 are free from adhesive along a major first end portion 14 opposite their second ends.

The dispenser 10 comprises walls having inner surfaces defining a cavity 16 which is adapted to receive the stack 13 of sheets 12. Those walls include first and second end walls 17 and 18, and a side wall 20 which is cylindrical and has opposite ends to which the first and second end walls 17 and 18 are attached. The first end wall or top wall 17 has an elongate outlet opening 22 for the cavity 16 between its inner and outer surfaces, through which outlet opening 22 individual sheets 12 from the stack 13 in the cavity 22 may be manually withdrawn, and against which first end wall 17 the stack 13 of sheets 12 is biased by novel biasing means 24 to afford proper dispensing of the sheets 12. The first end portion 14 of the uppermost of the dispensable sheets 12 extends through the outlet opening 22 and, because of upward projecting flanges 26 flanking the opening 22 (e.g., 0.2 inch or 0.5 centimeter high) at the sides of the outlet opening 22, projects upwardly above the outer surface of the first end wall 17, where that first end portion 14 may be grasped by a person to withdraw the sheet 12 from the dispenser 10. The dispenser 10 is intended to receive a stack 13 of about 100 or less sheets 12 in the cavity 16. The width of the outlet opening 22 together with flexible flap like portions 27 of the end wall 17 and force in the proper range applied by the biasing means 24, allows the sheets 12 from the stack 13 to be individually withdrawn rather easily, while still causing each sheet 11 as it is withdrawn to pull the end portion 14 of the sheet 12 beneath it through the opening 22 and then to separate from that sheet 11 as it is further withdrawn.

The novel means 24 in the cavity for biasing the stack 13 of sheets 12 toward the first end wall 17 comprises an elongate generally uniformly wide strip 28 of stiff resiliently flexible material which material can be 30 point craft card stock, about 1.63 inches or 4.14 centimeters wide. The strip 28 has transverse bends at spaced scored locations which shape the strip 28, and the strip 28 is resiliently flexible at those bends. The transverse bends in the strip define a generally planar pad support portion 30 having an upper surface positioned adjacent the first end wall 17 of the housing adapted to engage the side of the stack 13 of sheets 12 opposite the first end wall 17; two locating portions 31 of about equal length disposed generally at right angles to the pad support portion 30 and disposed generally in alignment with the opposite ends of the pad support portion 30, which locating portions 31 have supported ends 32 opposite the pad support portion 30 supported on the second end wall 18, and two force directing portions 34 between the pad support portion 30 and the locating portions 31. The two force directing portions 34 include first force directing parts 35 of about equal length having first ends attached by bends 36 at the opposite ends of the pad support portion 30, disposed at an acute angle with respect to the pad support portion 30 and projecting generally toward each other along a surface of the pad support portion opposite its upper surface; and two second force directing parts 38 of about equal length, having inner ends attached by bends 39 at the ends of the first force directing parts 35 opposite their first ends, which second force directing parts 38 extend generally away from each other from their inner ends and have ends opposite their inner ends attached by bends 40 to the ends of the locating portions 31 opposite their supported ends 32.

The space between and length of the locating portions 31 are adapted to afford storage of one or more (illustrated with three and space for many more) refill stacks 13 of sheets 12 in the space between the locating portions 31.

The elongate strip 38 further includes two base portions 42 and 43 projecting toward each other at about right angles with respect to the locating portions 31 from the supported ends 32 of the locating portions 31. The base portions 42 and 43 have parts that overlap each other and are attached together, which insures that the locating portions 31 do not move toward each other and thereby decrease their effective height within the cavity 16. Alternatively, the base portions 42 and 43 could be deleted and the supported ends 32 of the locating portions 31 could be received in sockets along the inner surface of the second end wall 18 or in a paper support disc adapted to lay along the inner surface of the second end wall 18.

The normal height of the shaped strip 28 between its pad support portion 30 and its supported ends 32 is greater than the space available in the cavity 16 when there is no stack 13 of sheets 12 between its pad support portion 30 and the first end wall 17 (e.g., about 0.41 inch or 1.04 centimeter greater); and, accordingly is also greater than the space available in the cavity 16 when there is a stack 13 of sheets between its pad support portion 30 and the first end wall 17 (e.g., about 0.62 inch or 1.5 centimeter greater when the stack 13 thickness is about 0.21 inch or 0.53 centimeter). The orientation of the force directing parts 34 and 38 and the resilient flexibility of the bends 36, 39 and 40 at the ends of those parts 34 and 38, however, allows resiliently flexible movement of the pad support portion 30 toward the locating portions 31 in a direction normal to its upper surface when both the stack 13 of sheets 12 and the shaped strip 38 are in the cavity 16. The resiliently flexible bends then apply a spring-like force against the stack 13 of sheets 12 to facilitate proper dispensing of the sheets 12 through the outlet opening 22.

The dispenser 10 includes means for affording releasable engagement of the top or first end wall 17 with the side wall 20 to afford removing the shaped strip 38 from the cavity 16 and moving a stack 13 of sheets 12 from between its locating portions 31 to a position adjacent its first end wall 17 from whence the sheets 12 on the stack 13 can be dispensed. The first end wall 17 has a cylindrical flange portion 46 adapted for a friction fit within the inner surface of the side wall 20, which flange portion 46 projects above a generally planar central portion 48 that has the outlet opening 22. At the edge of the cylindrical flange portion 46 opposite the central portion 48 is an annular channel 50 defining a groove adapted to frictionally receive an end portion of the side wall 20. Such frictional engagement of the side wall 20 in the channel 50 and with the flange portion 46 is sufficient to retain the first end wall 17 in place against the biasing of the biasing means 24, however the first end wall 17 can be pulled off of the end of the side wall 20 by manually engaging a inwardly projecting ledge 52 on the flange 46.

The first end wall 17 can be molded of a polymeric material and can have slots 53 at the ends of the outlet opening 22 that form the flap like portions 27 of the first end wall 17 adjacent the outlet opening 22 that are flexible and thereby facilitate dispensing of sheets 12 from the stack 13. Also, the first end wall 17 can be molded with arcuate plates 54 at the end of the opening 22 that project into the cavity 16 along the sides of the stack 13 to keep it properly aligned with the opening 22.

The second end wall 18 can be of metal (e.g., 0.0085 inch or 0.0215 centimeter thick steel) or polymeric material, and if of metal, can be fixed to the end of the cylindrical side wall 20 as illustrated by having a flange 56 around its periphery clamped over an end portion of the side wall 20 by conventional can seaming techniques that are well known in the art of making mailing tubes. Alternatively, the second end wall 18 could removably engage the side wall 20 in the same way it is removably engaged by the first end wall 17.

As an example, the first end wall 17 can be of 0.3 inch thick low density polyethylene, the outlet opening 22 can be 0.438 inches or 1.11 centimeters wide, and the first end wall can have 0.875 inch or 2.22 centimeter long slots 53 at the ends of the outlet opening 22 that form the flap like portions 27 of the first end wall 17. When the shaped strip 28 is made of 1.63 inches or 4.14 centimeters wide 30 point craft card stock it has been found to provide sufficient force against the stack 13 of sheets 12 to facilitate proper dispensing (e.g., about 200 grams on a 50 sheet pad reducing to about 20 grams for the last sheets dispensed from that pad), which force, under appropriate storage conditions for card stock, decreases slightly over time, but even then causes the dispenser 10 to will work properly for a long time. Such a shaped strip 28 can be removed from the cavity 16 without any concern that it could injure the person who removes it.

It should be possible to make the strip 28 of polymeric material that is scored to increase its resilient flexibility at the bends.

The cylindrical side wall 20 of the housing preferably has the same inexpensive construction as conventional mailing tubes, and can have a paper label pasted around (or printing around) its cylindrical outer surface that bears decorative printing and/or information for the user of the dispenser 10.

The dispenser can be made with side walls of different diameters and heights, including, for example, side walls about 2.5 inches or 6.35 centimeters in diameter and 2 to 5 inches or 5.08 to 12.7 centimeters high which can dispense 1.5 by 2 inch or 3.8 by 5.08 centimeter sheets 12; or side walls 3.5 inches or 8.89 centimeters in diameter and 1.75 to 4 or 4.45 to 10.16 inches high which can dispense larger sheets.

Alternatively, by adjusting the size of the outlet opening and the side slots the dispenser should be able to dispense sheets of the type described in U.S. Pat. No. 4,907,825 (i.e., the stack of sheets sold in a dispenser under the trade designation "Post-it" (™) Tape Flags by Minnesota Mining and Manufacturing Company) the content of which U.S. Pat. No. 4,907,825 that describes those sheets being hereby incorporated herein by reference.

The assembly according to the present invention has now been described with reference to one embodiment and several possible modifications thereof. It will be apparent to those skilled in the art that many other changes or additions can be made in the embodiment described without departing from the scope of the present invention. Thus, the scope of the present invention should not be limited to the structure described in this application, but only by structures described by the language of the claims and the equivalents of those structures.

I claim:

1. A sheet dispenser for flexible sheets from a stack of sheets disposed one on top of another, said sheet dispenser comprising:

walls having inner surfaces defining a cavity adapted to receive the stack and having opposite outer surfaces, said walls including a first end wall having an elongate outlet opening for said cavity between said inner and outer surfaces through which individual sheets from the stack in the cavity may be manually withdrawn, a second end wall, and at least one side wall, said side wall having opposite ends, having one of said ends engaged with said first end wall and the other of said ends engaged with said second end wall; and means in said cavity for biasing the stack of sheets toward said first end wall, said means for biasing comprises an elongate strip of stiff resiliently flexible material, said strip having transverse bends at spaced locations, being resiliently flexible at said bends, and defining with said bends a generally planar pad support portion having opposite ends and upper and lower surfaces, said upper surface being positioned adjacent said first end wall;

two locating portions of about equal length disposed generally at right angles to said pad support portion and disposed generally in alignment with the opposite ends of said pad support portion, said locating portions having supported ends opposite said pad support portion supported on said walls, and two force directing portions between said pad support portion and said locating portions including first force directing parts of about equal length, having first ends attached by bends at the opposite ends of said support portion, disposed at an acute angle with respect to said pad support portion and projecting generally toward each other along the lower surface of said pad support portion, and two second force directing parts of about equal length, having inner ends attached by bends at the ends of said first force directing parts opposite said first ends, said second force directing parts extending generally away from each other from said inner ends and having ends opposite said inner ends attached by bends to the ends of said locating portions opposite said supported ends, the space between and length of said locating portions being adapted to afford storage of at least one refill pad of notes in the space between said locating portions.

2. A sheet dispenser according to claim 1 wherein said strip is formed of card stock.

3. A sheet dispenser according to claim 1 wherein said elongate strip further includes two base portions projecting toward each other at about right angles with respect to said locating portions from the supported ends of said locating portions, said base portions having portions overlapping each other and attached together.

4. A sheet dispenser according to claim 1 wherein said side wall is cylindrical, and said dispenser includes means for affording releasable engagement of at least one of said end walls with said side wall to afford moving a pad from between said base portions to a position adjacent said top wall.

5. A sheet dispenser according to claim 1 wherein the space between and length of said locating portions is adapted to afford storage of a plurality of refill pads of notes.

* * * * *